US008038762B2

(12) United States Patent
Kuwabara et al.

(10) Patent No.: US 8,038,762 B2
(45) Date of Patent: Oct. 18, 2011

(54) PROCESS FOR PRODUCTION OF CHAIN METAL POWDERS, CHAIN METAL POWERS PRODUCED THEREBY, AND ANISOTROPIC CONDUCTIVE FILM FORMED BY USING THE POWDERS

(75) Inventors: Tetsuya Kuwabara, Osaka (JP); Hideaki Toshioka, Osaka (JP); Hideki Kashihara, Osaka (JP); Keiji Koyama, Osaka (JP); Takashi Sakai, Hyogo (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 131 days.

(21) Appl. No.: 12/687,014

(22) Filed: Jan. 13, 2010

(65) Prior Publication Data

US 2010/0175507 A1 Jul. 15, 2010

Related U.S. Application Data

(60) Division of application No. 11/579,186, filed on Oct. 30, 2006, now Pat. No. 7,850,760, which is a continuation of application No. PCT/JP2005/007987, filed on Apr. 27, 2005.

(30) Foreign Application Priority Data

Apr. 30, 2004 (JP) ..... 2004-136583
May 10, 2004 (JP) ..... 2004-140326

(51) Int. Cl.
*B22F 9/26* (2006.01)

(52) U.S. Cl. ..... 75/347; 75/348; 75/371

(58) Field of Classification Search ..... None
See application file for complete search history.

(56) References Cited

U.S. PATENT DOCUMENTS

| | | | | |
|---|---|---|---|---|
| 3,902,888 | A | 9/1975 | Aonuma et al. | |
| 4,063,000 | A * | 12/1977 | Aonuma et al. | 428/403 |
| 4,141,763 | A | 2/1979 | Aonuma et al. | |
| 4,214,893 | A | 7/1980 | Tsuganezawa et al. | |
| 4,217,152 | A | 8/1980 | Aonuma et al. | |
| 5,435,830 | A | 7/1995 | Senda et al. | |
| 2001/0009118 | A1 | 7/2001 | Hosoe et al. | |
| 2003/0094076 | A1 | 5/2003 | Hosoe et al. | |
| 2003/0205404 | A1 | 11/2003 | Hara et al. | |
| 2004/0033357 | A1 | 2/2004 | Hattori et al. | |
| 2004/0232386 | A1 | 11/2004 | Yorita et al. | |
| 2005/0106382 | A1 | 5/2005 | Kashihara et al. | |
| 2005/0217425 | A1 | 10/2005 | Inazawa et al. | |

FOREIGN PATENT DOCUMENTS

| | | |
|---|---|---|
| JP | 47-41718 | 10/1972 |
| JP | 50-112800 | 9/1975 |
| JP | 53-29239 | 8/1978 |
| JP | 54-140199 | 10/1979 |
| JP | 56-77303 | 6/1981 |
| JP | 07-074013 | 3/1995 |
| JP | 11-302704 | 11/1999 |
| JP | 3018655 | 1/2000 |
| JP | 2001-200305 A | 7/2001 |
| JP | 2002-86137 | 3/2002 |
| JP | 2003-126844 | 5/2003 |
| JP | 2003-331951 | 11/2003 |
| JP | 2003-346556 | 12/2003 |
| JP | 2004-18923 | 1/2004 |
| JP | 2004-149897 | 5/2004 |
| JP | 2004-292850 | 10/2004 |
| TW | 264735 | 10/2006 |
| WO | WO 03/019579 A1 | 3/2003 |

OTHER PUBLICATIONS

U.S. Office Action, issued in U.S. Appl. No. 11/579,186, mailed Mar. 23, 2010.
Japanese Office Action issued in Japan Patent Application No. 2004-136583 dated Feb. 4, 2010.
Japanese Office Action issued in Japan Patent Application No. 2004-140326 dated Feb. 4, 2010.
Taiwanese Office Action issued in Taiwanese Patent Application No. 094113799, dated Feb. 26, 2010.
A.L. Oppegard et al. "Magnetic Properties of Single-Domain Iron and Iron-Cobalt Particles Prepared by Borohydride Reduction" (The Journal of Applied Physics, vol. 32, No. 3 184S-185S Mar. 1961).
Vadin V. Sviridov et al. "Use of Ti (III) Complexes to Reduce Ni, Co, and Fe in Water Solutions" The Journal of Physical Chemistry 100, 19632-19635 (1996).
Chinese Office Action, with English translation thereof, issued in Patent Application No. 200580022069.3 dated on Aug. 8, 2008.
D.R. Mehandjiev and I.D. Dragieva, "Effect of the globule size on the interglobular space formation in ferromagnetic chain powders," Journal of Magnetism and Magnetic Materials, vol. 101, 1991, pp. 167-169, XP002523172.
European Search Report issued in European Patent Application No. EP 05737372 dated May 13, 2009.
International Preliminary Report on Patentability issued in corresponding International Application No. PCT/JP2005/007987, mailed Nov. 9, 2006.
International Preliminary Report on Patentability issued in corresponding International Application No. PCT/2005/007987, mailed Nov. 23, 2006.

* cited by examiner

*Primary Examiner* — George Wyszomierski
(74) *Attorney, Agent, or Firm* — McDermott Will & Emery LLP

(57) ABSTRACT

A process for production of a chain metal powder, which comprises the steps of reducing metal ions contained in an aqueous solution, while applying a magnetic filed to the solution, in the presence of both a reducing agent capable of generating a gas during the reduction of metal ions and a foamable water soluble compound, through the generation of a gas, a bubble layer on the surface of the aqueous solution to form a chain metal powder, separating the bubble layer formed on the surface of the aqueous solution from the solution, and collecting the chain metal powder contained in the bubble layer.

3 Claims, No Drawings

PROCESS FOR PRODUCTION OF CHAIN METAL POWDERS, CHAIN METAL POWERS PRODUCED THEREBY, AND ANISOTROPIC CONDUCTIVE FILM FORMED BY USING THE POWDERS

RELATED APPLICATIONS

This application is a Divisional of U.S. application Ser. No. 11/579,186, filed on Oct. 30, 2006, now U.S. Pat. No. 7,850, 760 which is a continuation of International Application No. PCT/JP2005/007987 filed on Apr. 27, 2005, claiming priority of Japanese Patent Application Nos. 2004-136583, filed on Apr. 30, 2004 and 2004-140326, filed on May 10, 2004, the entire contents of each of which are hereby incorporated reference.

TECHNICAL FIELD

The present invention relates to process for production of chain metal powders having a shape in which a lot of fine metal particles are bonded in a chain form, chain metal powders produced thereby, and an anisotropic conductive film formed by using the chain metal powders.

BACKGROUND ART

An anisotropic conductive film is used in one of processes for mounting electronic components whereby a semiconductor package is mounted on a printed wiring board, or conductor circuits formed on the surfaces of two printed wiring boards are electrically connected with each other and the two printed wiring boards are secured with respect to each other.

In the case of mounting a semiconductor package, for example, a semiconductor package having a connection section where a plurality of electrodes called bumps are disposed on a surface thereof which is to be placed on a printed wiring board for mounting thereon, and a printed wiring board having a connection section where a plurality of electrodes are disposed in the same pitch as the bumps are prepared. The semiconductor package and the printed wiring board are disposed so that the connection sections thereof face each other, with the corresponding electrodes on both connection sections being aligned to overlap one-on-one in the plane direction of the film, and are bonded together by thermal bonding with an anisotropic conductive film interposed therebetween, thereby mounting the semiconductor package on the printed wiring board.

In the case of connecting two printed wiring boards, two printed wiring boards each having a connection section where a plurality of electrodes are disposed in the same pitch are prepared. The two printed wiring boards are disposed so that both connection sections thereof face each other, with the corresponding electrodes on both connection sections being aligned to overlap one-on-one in the plane direction of the film, and are bonded together by thermal bonding with an anisotropic conductive film interposed therebetween, thereby connecting the conductor circuits on both sides and securing the two printed wiring boards with respect to each other.

The anisotropic conductive film used in mounting of electronic components typically has such a structure as a powdered conductive component is dispersed in a film containing a binder of various resins and has heat sensitive adhesion property. The content ratio of the conductive component in the anisotropic conductive film is controlled so as to have higher conductive resistance (referred to as "insulation resistance") in the plane direction, in order to prevent short circuiting in the plane direction of the film, namely to prevent each pair of opposing electrodes facing each other with interposing the film therebetween from short circuiting with an other pair of adjacent electrodes within the surface.

When the anisotropic conductive film is used in thermal bonding, since the anisotropic conductive film is compressed in the thickness direction by heat and pressure applied thereto, content ratio of the conductive component in the thickness direction increases so that the electrically conductive powders are brought closer to or into contact with each other to form a network of electrical conductivity. As a result, conductive resistance (referred to as "connection resistance") of the anisotropic conductive film in the thickness direction decreases. However, since the content ratio of the conductive component in the plane direction of the anisotropic conductive film does not increase, the initial state that the insulation resistance is high and electrical conductivity is low is maintained in the plane direction.

Thus the anisotropic conductive film has a property of anisotropic electrical conductivity, namely connection resistance is low in the thickness direction and insulation resistance is high in the plane direction. This property of anisotropic electrical conductivity enables the followings:

[A] while maintaining each pair of opposing electrodes independent from others by preventing the electrodes from short circuiting in the plane direction of the film;

[B] to establish good electrical conductive connection between each pair of opposing electrodes that face each other via the film. At the same time, it is also possible to secure a semiconductor package on a printed wiring board by thermal bonding or secure printed wiring boards with respect to each other by thermal bonding, by the heat sensitive adhesion property of the anisotropic conductive film itself. As a result, use of the anisotropic conductive film makes the operation simpler to mount electronic components.

Various metal powders have been put into practical use as the conductive component contained in the anisotropic conductive film, such as those consisting of powders of a shape such as granule, sphere, or lamella (scale, flake) having an average particle diameter ranging from several micrometers to several tens of micrometers. Particularly in recent years attention is drawn to a chain metal powder having a shape in which fine metal particles are bonded in a chain form.

Since the chain metal powder has large specific surface area than a granular ones, it has an excellent dispersibility to the binder. And it has lager aspect ratio, adjacent chain metal powders tend to connect with each other so as to easily form a network of good electrical conductivity while being dispersed in the film. Accordingly, the chain metal powder used as an conductive component makes it possible to form an anisotropic conductive film having better electrical conductivity in the thickness direction with smaller amount of filling than in the case of conventional powders.

Also in case the chain metal powder contains a ferromagnetic metal as described hereinafter, upon application of a magnetic field, the chain metal powder are oriented in a certain direction accordingly. For example, it is also made possible to further improve the anisotropic electrical conductivity of the anisotropic conductive film by applying a magnetic field in the process for the production of the anisotropic conductive film thereby orienting the chain metal powder in the thickness direction of the film. In order to have the chain metal powder oriented in the direction of film thickness, for example, such a process may be employed as to produce the anisotropic conductive film by applying a liquid mixture containing a chain metal powder and a binder onto a flat surface and solidifying the mixture by drying or other means, while applying a magnetic field to the mixture that has been spread over the flat surface and has not yet solidified, thereby solidifying the mixture in the state where the chain metal powder is oriented in the thickness direction so that the direction of orientation of the chain metal powder is fixed.

Use of the chain metal powder also makes it possible to produce an electrically conductive paste that enables to form an electrically conductive film having better electrical conductivity, an electrically conductive sheet having higher electrical conductivity or an active material compound for a battery having excellent collecting ability, while using a smaller amount of filling than in the case of conventional ones. Unprecedented applications may also be opened up by making use of the peculiar particle shape of the chain metal powder in such fields as capacitor, catalyst, electromagnetic shielding material, etc.

A chain metal powder containing a ferromagnetic metal such as Ni, Fe or Co, or an alloy thereof can be produced by the reduction deposition method, according to which, a lot of the fine metal particles are deposited by the action of a reducing agent in an aqueous solution containing ions of these metals. The submicron-sized fine metal particles made of the ferromagnetic metal or alloy in the early stage of deposition have a single magnetic domain structure or a similar structure, and are therefore simply polarized into bipolar state so as to exhibit magnetism. A lot of metal particles that exhibit magnetism are bonded in a chain form through the magnetism, thereby to form the chain metal powder. When the metal further deposits so as to cover the lot of metal particles that are bonded in the chain form, a chain metal powder is formed that the metal particles bond more firmly with each other.

However, the chain metal powder of the conventional reduction deposition method only produces a configuration such as a branching shape that many chains are branched out or, even when there are few branches, a bending shape that the chains are significantly bent or bent several times. The chain metal powders may be nonetheless useful, for example, in forming a good network of electrical conductivity in a binder. In order to make better use of the peculiar configuration of chain, however, it is preferable to produce a chain metal powder that has not only fewer branches but also has a linear shape or close to it. It is also important that the chain metal powder consisting of linear shape has small distribution of the chain length, in order to equalize properties when orienting a lot of chain metal powders in the same direction.

For example, the anisotropic conductive film is rendered the anisotropic electrical conductivity thereof by orienting the lot of chain metal powders in the thickness direction. With respect to the anisotropic conductive film having such a structure in order to reliably prevent short circuiting between adjacent electrodes which are arranged at very narrow pitch in the connection sections of the electronic component and the printed wiring board, it is required that:

[C] adjacent chain metal powders contained in the film do not form a network of electrical conductivity due to branching, namely the powders have as few branches as possible; and

[D] the chain metal powders oriented in the thickness direction do not cause short circuiting between adjacent electrodes even when the powders fall down in the plane direction of the film when a printed wiring board and an electronic component or two printed wiring boards are pressed so as to be bonded together with the anisotropic conductive film interposed therebetween, namely lengths of the powders are controlled to be less than the distance between the adjacent electrodes.

In order to meet the requirements described above, it has been proposed to carry out a reduction deposition method while applying a magnetic field to an aqueous solution. With this method, since a number of fine metal particles deposited in the aqueous solution can be bonded in a chain form while being oriented in the direction of magnetic field through the magnetism of the particles themselves, it is made possible to produce a chain metal powder that have fewer branches than in the case where magnetic field is not applied, and have linear shape.

For example, Non-Patent Document 1 describes that a chain metal powder consisting of linear shape can be obtained when Fe or Fe—Co is deposited while applying a magnetic field to an aqueous solution in a reduction deposition reaction conducted in the aqueous solution by using boron hydride as a reducing agent and that, in the case of Fe, it is necessary to apply a magnetic field of at least 10 mT, preferably 100 mT or more intensity in order to make the chain metal powder consisting of linear shape.

Non-Patent Document 2 describes that a chain metal powder can be obtained when Ni, Co or Fe is deposited in a reduction deposition reaction in an aqueous solution by using a trivalent Ti compound as a reducing agent, and that the chain metal powder consisting of linear shape of Ni can be obtained by applying a magnetic field of 100 mT during the reaction.

However, the chain metal powders produced by these processes include powders having some branches which can not be completely eliminated. Also since the above-described processes are not capable of controlling the chain length, the chain metal powder produced thereby is varying in length from very short to extremely long.

When the chain metal powder that have some branches and varies in length is used as a conductive component of the anisotropic conductive film, for example, the anisotropic conductive film may not have sufficiently high insulation resistance in the plane direction of the film even when the chain metal powder is oriented in the thickness direction of the film. Moreover, as the pitch between the adjacent electrodes becomes smaller, there increases a possibility that long particles of the chain metal powder to fall down in the plane direction of the film and cause short circuiting during pressure bonding.

Non-Patent Document 1: "Magnetic Properties of Single-Domain Iron and Iron-Cobalt Particles Prepared by Boron-hydride Reduction", A. L. Oppegard, F. J. Darnell and H. C. Miller, The Journal of Applied Physics, 32 (1961) 184s Non-Patent Document 2: "Use of Ti(III) complexes To reduce Ni Co and Fe in Water Solutions", V. V. Sviridov, G. P. Shevchenko, A. S. Susha and N. A. Diab, The Journal of Physical Chemistry, 100 (1996) 19632

DISCLOSURE OF THE INVENTION

Problems to be Solved by the Invention

An object of the present invention is to provide a process for production of a chain metal powder by a reduction deposition method, which contains few branches and has a shape that is as close as possible to a linear shape and also has small distribution of chain length, and a chain metal powder having these excellent characteristics produced thereby. Another object of the present invention is to provide an anisotropic conductive film, which is excellent in insulation resistance in a plane direction of a film and is less likely to cause a short circuiting even if a pitch between adjacent electrodes is decreased, by using the chain metal powder.

Means for Solving the Problems

The process for production of a chain metal powder of the present invention, which comprises the steps of reducing ferromagnetic metal ions contained in an aqueous solution through the action of a reducing agent while applying a magnetic field to the solution in a fixed direction thereby to deposit fine metal particles, and bonding a lot of the fine metal particles in a chain form so as to orient the fine metal particles in a direction of the applied magnetic field through magnetism of the fine metal particles, characterized in that the reduction deposition reaction is conducted in the presence of a polymer compound comprising:

(a) repeating units represented by the formula (1):

[Chemical Formula 1]

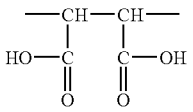

(1)

and (b) repeating units represented by the formula (2):

[Chemical Formula 2]

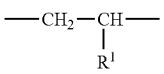

(2)

wherein $R^1$ represents an aromatic group which may have a substituent, or a cycloalkyl group.

Further, the process for production of a chain metal powder of the present invention is characterized in that the reduction deposition reaction is conducted in the presence of a polymer compound comprising:

(d) repeating units represented by the formula (1):

[Chemical Formula 3]

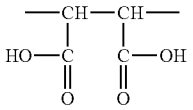

(1)

and (e) repeating units represented by the formula (4):

[Chemical Formula 4]

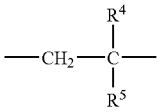

(4)

wherein $R^4$ and $R^5$ are the same or different and represent a hydrogen atom or an alkyl group, provided that $R^4$ and $R^5$ are not simultaneously hydrogen atoms.

According to the present inventors' study, when metal particles are deposited by a reduction deposition reaction, while applying a magnetic field, in the presence of a dispersing agent such as polyacrylic acid, a chain formed by bonding a lot of deposited metal particles so as to orient in the direction of a magnetic field is covered with the dispersing agent, thereby inhibiting the occurrence of branching in the chain and cohesion of plural chains, and thus a nearly linear chain metal powder containing few branches can be produced.

Since a conventional dispersing agent such as polyacrylic acid is excellent in the function of inhibiting the occurrence of branching but has insufficient or no function of controlling the chain length, it was impossible to arrange the length chain in the nearly fixed range by solving such a problem that the chain metal powder has a large distribution of the chain length, that is, the chain metal powders having a very long chain length and the chain metal powders having a short chain length are simultaneously present.

Thus, the present inventors have studied more intensively and found that when a reduction deposition process is conducted, while applying a magnetic field, using:

(I) a copolymer compound comprising the repeating units represented by the formula (1) and the repeating units represented by the formula (2), or (II) a copolymer compound comprising the repeating units represented by the formula (1) and the repeating units represented by the formula (4) as a dispersing agent, it becomes possible to produce a chain metal powder which is substantially free from branches and has a small distribution of the chain length.

This reason is not clear but is considered as follows: Since either polymer compound (I) and (II) mentioned above have, in the main chain, numbers of hydrophilic moieties composed of the repeating unit represented by the formula (1) and numbers of a hydrophobic moieties composed of the repeating unit represented by the formula (2) or (4), a lot of metal particles deposited in the aqueous solution or the chain formed by bonding the deposited metal particles so as to orient in the direction of a magnetic field are largely covered with the dispersing agent as compared with a conventional dispersing agent, and thus proximity between the metal particles, connection through a magnetic force and chain growth caused thereby can be satisfactorily controlled.

Therefore, according to the present invention, it becomes possible to produce a chain metal powder which is substantially free from branches and has a small distribution of the chain length by the reduction deposition process.

The polymer compound (I) can further comprise:

(c) repeating units represented by the formula (3):

[Chemical Formula 5]

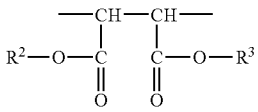

(3)

wherein $R^2$ and $R^3$ are the same or different and represent a hydrogen atom, an alkyl group which may have a substituent, a cycloalkyl group, an ammonium group or an alkali metal atom, provided that $R^2$ and $R^3$ are not simultaneously hydrogen atoms. The polymer compound (II) can further comprise:

(f) repeating units represented by the formula (5):

[Chemical Formula 6]

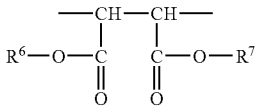

(5)

wherein $R^6$ and $R^7$ are the same or different and represent a hydrogen atom or an ammonium group, provided that $R^6$ and $R^7$ are not simultaneously hydrogen atoms.

Since these repeating units are hydrophilic similar to the repeating units represented by the formula (1), hydrophilicity can be adjusted by selecting a type of the substituent. Therefore, balance between hydrophilicity and hydrophobicity in the polymer compounds (I) and (II) is finely adjusted by selecting a content of the repeating units represented by the formula (3) or (5) and a type of the substituent in each repeating unit, and thus the number of branches and the chain length of the chain metal powder can be arbitrarily adjusted by finely controlling proximity between metal particles, connection through a magnetic force and chain growth caused thereby during the reduction deposition.

The process for production of a chain metal powder of the present invention is characterized in that the reduction deposition reaction is conducted in the presence of:

(g) a reducing agent for generating a gas during the reduction of metal ions, or a combination of the reducing agent and a foaming agent capable of generating a gas; and (h) a foamable water soluble compound for generating a bubble layer on the surface of the aqueous solution by generation of the gas and the bubble layer formed on the surface of the aqueous solution is separated from the aqueous solution and then the chain metal powder contained in the bubble layer is collected.

In the process of the present invention, when a lot of the fine metal particles deposited through the reduction deposition reaction while applying a magnetic field are bonded in a chain form so as to orient in a direction of a magnetic field, it is made possible to produce a chain metal powder which contains fewer branches as compared with the case of applying no magnetic field, and has a straight shape which is linear or close thereto.

Among the produced chain metal powders, those having comparatively short chain length are selectively carried onto the surface of the aqueous solution by bubbles of a gas generated in the aqueous solution and then accumulated to the bubble layer formed on the surface of the aqueous solution, and thus it is made possible to produce a chain metal powder having a short chain length of a small distribution of a certain range by separating the bubble layer from the aqueous solution and collecting chain metal powder contained in the bubble layer.

As the foamable water soluble compound, a foamable dispersing agent is preferable. As described above, when the chain is formed by bonding a lot of deposited metal particles deposited by the reduction deposition reaction so as to orient in the direction of a magnetic field, and covered with the foamable dispersing agent, the foamable dispersing agent inhibits the occurrence of branching in the chain and cohesion of plural chains. Therefore, it is made possible to produce a nearly linear chain metal powder containing fewer branches as compared with the case where a magnetic field is merely applied.

The chain metal powder thus produced is made to be hydrophobic as is covered with a dispersing agent and affinity to bubbles of a gas is improved as compared with water, and thus the chain metal powder adheres to bubbles and is carried to the bubble layer with ease. Therefore, collection efficiency of the chain metal powder having a short chain length contained in the bubble layer can be improved. Moreover, since the dispersing agent is foamable, there is an advantage that the cost of the process for production of the chain metal powder can be reduced as compared with the case of using the foamable water soluble compound in combination with the unfoamable dispersing agent.

In the process of the present invention, by using trivalent Ti ions [Ti(III)] clustered with tetravalent Ti ions [Ti(IV)] as the reducing agent of the reduction deposition reaction, sphericity of the metal particles can be enhanced and also the primary particle diameter can be more decreased.

Ti (III) has a function of serving as a reducing agent in the case of being oxidized itself to Ti(IV) thereby to reduce metal ions and to cause deposition, and thus growing metal particles, while Ti(IV) has a function of inhibiting the growth of metal particles. Regarding both ions, plural ions each constitute a cluster in an aqueous solution and are entirely present in the state of being hydrated and complexed.

Therefore, when the reduction deposition reaction is conducted in the state where both ions are simultaneously present, the growth stimulation function due to Ti(III) and the growth inhibitory function due to Ti(IV) are exerted on one same metal particle in one cluster and thus it is possible to grow metal particles more slowly. As a result, it is possible to enhance sphericity of metal particles and decrease the primary particle diameter more.

According to this process, since it is possible to adjust functions, which conflict with each other, in the cluster by controlling a ratio of the contents of Ti(III) and Ti(IV) upon initiation of the reaction, the primary particle diameter of metal particles can be optionally controlled. Moreover, when the aqueous solution in which all Ti ions are oxidized to Ti(IV) ions after the production of the chain metal powder is electrolytically regenerated thereby to reduce a part of Ti ions to Ti(III) ions again, the solution can be repeatedly regenerated thereby to attain a state suited for use in the production of the chain metal powder. Therefore, it becomes possible to reduce the cost of the process for the production of a chain metal powder according to the reduction deposition process.

Moreover, since Ti ions used as the reducing agent are hardly remained as impurities in the deposited metal particles, a high-purity chain metal powder can be produced. Therefore, even in the case of using not only metal having large saturation magnetization in a bulk material, such as an Fe or Fe—Co alloy, but also metal having a small saturation magnetization in a bulk material, such as Ni, metal particles having high purity and strong magnetism can be made and a chain metal powder can be produced by bonding a lot of metal particles in a chain form through magnetism of the metal particles themselves, while orienting the metal particles in the direction of a magnetic field is applied.

The chain metal powder of the present invention is characterized in that produced by any of the processes described above and having a shape in which fine metal particles are bonded in a linear form.

Since the chain metal powder of the present invention contains few branches and has a shape that is as close as possible to a linear shape and also has small distribution of the chain length, it becomes possible to utilize the characteristics of the chain shape in various fields such as anisotropic conductive films, conductive pastes, conductive sheets, etc. as compared with the chain metal powder of the prior art.

The anisotropic conductive film of the present invention is characterized in that the chain metal powder of the present invention having the chain length less than the distance between the adjacent electrodes within the same surface is contained in the film in the state where the powders are oriented in the thickness direction of the film.

As described above, in the case of the anisotropic conductive film of the present invention, the chain metal powder of the present invention, which contains few branches and has a shape that is as close as possible to a linear shape and also has a small distribution of the chain length, is used as a conductive component and also the chain length is set to less than the distance between adjacent electrodes constituting the connection section for conductive connection. Therefore, it is possible to reliably prevent the occurrence of short circuiting even if the chain metal powder oriented in the thickness direction of the film so as to impart excellent anisotropic electrical conductivity falls down in the plane direction of the film in the case of interposing an anisotropic conductive film between a substrate and an element or two substrates in press-bonding.

Therefore, by applying the anisotropic conductive film of the present invention, even if a pitch between adjacent electrodes become narrow because of the requirements of high density mounting, it becomes possible to sufficiently cope with the requirements.

BEST MODE FOR CARRYING OUT THE INVENTION

The present invention will now be described.

<Process for Production of a Chain Metal Powder and Chain Metal Powder>>

As described above, the process for production of a chain metal powder of the present invention, which comprises the steps of reducing ferromagnetic metal ions contained in an aqueous solution through the action of a reducing agent while applying a magnetic field to the solution in a fixed direction thereby to deposit fine metal particles, and bonding a lot of the fine metal particles in a chain form so as to orient the fine metal particles in a direction of the applied magnetic field through magnetism of the fine metal particles, characterized in that the reduction deposition reaction is conducted in the presence of a polymer compound of the formula (1) (hereinafter referred to as a "polymer compound (I)") or a polymer compound of the formula (II) (hereinafter referred to as a "polymer compound (II)"). The chain metal powder of the present invention is characterized in that produced by any of the process described above.

[Chain Metal Powder]

The chain metal powder of the present invention includes, for example, the following (A) to (F) alone or a mixture of two or more kinds of them:

(A) a chain metal powder which is produced by bonding a lot of submicron-sized metal particles formed of a simple substance of metal having ferromagnetism, an alloy of two or more kinds of metals having ferromagnetism or an alloy of a metal having ferromagnetism and the other metal in a chain form through magnetism of the metal particles, (B) a chain metal powder which is produced by further coating a metal layer made of a simple substance of metal having ferromagnetism, an alloy of two or more kinds of metals having ferromagnetism or an alloy of a metal having ferromagnetism and the other metal onto the surface of the chain metal powder (A) thereby to firmly bond metal particles through the same bonding strength as that of a metal bond, (C) a chain metal powder which is produced by further coating a coating layer made of the other metal or an alloy onto the surface of the chain metal powder (A) thereby to firmly bond metal particles through the same bonding strength as that of a metal bond, and (D) a chain metal powder which is produced by further coating a coating layer made of the other metal or an alloy onto the surface of the chain metal powder (B) thereby to firmly bond metal particles through the same bonding strength as that of a metal bond.

Examples of the metal or alloy having ferromagnetism, which forms metal particles, include Ni, Fe, Co and alloys of two or more kinds of them, and a simple substance of Ni and a Ni—Fe alloy (permalloy) are particularly preferable. Metal particles made of the metal or alloy have strong magnetic interaction in the case of bonding to the chain and are therefore excellent in the effect of decreasing contact resistance between metal particles thereby to improve conductivity in the chain metal powder.

Examples of the other metal, which forms the chain metal powder together with the metal or alloy having ferromagnetism, include at least one metal having excellent conductivity selected from the group consisting of Cu, Rb, Rh, Pd, Ag, Re, Pt and Au. Taking account of an improvement in conductivity of the chain metal powder, the portion formed of these metals is preferably a coating layer exposed to the external surface of the chain, like the chain metal powders (C) and (D).

As described hereinafter, the metal layer is formed by continuously conducting the reduction deposition even after the deposited chain metal powder is bonded to the chain to form a chain metal powder. The coating layer can be formed, for example, by various film forming processes such as an electroless plating process, an electroplating process, a reduction deposition process and a vacuum deposition process. The coating layer may have a single-layered structure made of the metal or alloy having excellent conductivity, and may have a two- or multi-layered structure made of the same or different metal or alloy.

[Reducing Agent]

As the reducing agent in the process of the present invention, for example, there can be used various reducing agents having a function of reducing metal ions in an aqueous solution thereby to deposit metal particles, such as hypophosphites, a boron hydride compound, hydrazine and Ti(III), and Ti(III) clustered with Ti(IV) is particularly preferable. Consequently, sphericity of the metal particles can be enhanced and also the primary particle diameter can be more decreased.

Ti(III) has a function of serving as a reducing agent in the case of being oxidized itself to Ti(IV) thereby to reduce metal ions and to cause deposition, and thus growing metal particles, while Ti(IV) has a function of inhibiting the growth of metal particles. Regarding both ions, plural ions each constitute a cluster in an aqueous solution and are entirely present in the state of being hydrated and complexed.

Therefore, when the reduction deposition reaction is conducted in the state where both ions are simultaneously present, the growth stimulation function due to Ti(III) and the growth inhibitory function due to Ti(IV) are exerted on one same metal particle in one cluster and thus it is possible to grow metal particles more slowly. As a result, it is possible to enhance sphericity of metal particles and decrease the primary particle diameter more.

According to this process, since it is possible to adjust functions, which conflict with each other, in the cluster by controlling a ratio of the contents of Ti(III) and Ti(IV) upon initiation of the reaction, the primary particle diameter of metal particles can be optionally controlled. Moreover, when the aqueous solution in which all Ti ions are oxidized to Ti(IV) ions after the production of the chain metal powder is electrolytically regenerated thereby to reduce a part of Ti ions to Ti(III) ions again, the solution can be repeatedly regenerated thereby to attain a state suited for use in the production of the chain metal powder. Therefore, it becomes possible to reduce the cost of the process for the production of a chain metal powder according to the reduction deposition process.

[Production of Chain Metal Powder]

In an example of an embodiment of the process for production of a chain metal powder of the present invention in which Ti(III) clustered with Ti(IV) is used as a reducing agent, first,

[1] an aqueous solution containing one or more metal ions constituting metal particles and a complexing agent (hereinafter referred to as an "aqueous metal ion solution"),

[2] an aqueous solution containing Ti(III) and Ti(IV) (hereinafter referred to as an "aqueous reducing agent solution"), and

[3] an aqueous solution containing a polymer compound (I) or (II) and ammonia or the like as a pH adjustor (hereinafter referred to as an "aqueous dispersing agent solution") are separately prepared.

After the aqueous metal ion solution is mixed with the aqueous reducing agent solution, the aqueous dispersing agent solution is added to the solution mixture, while applying a magnetic field in a fixed direction, and the pH of the solution is adjusted within a range from 9 to 10. As a result, a cluster is formed by Ti(III), Ti(IV) and metal ions in the solution mixture (hereinafter referred to as a "reaction solution") and trivalent Ti ions and a complexing agent are bonded to form a coordination compound in the cluster and thus activation energy in the case of oxidizing Ti(III) to Ti(IV) decreases and thus a reduction potential increases.

Specifically, electric potential difference between Ti(III) and Ti(IV) exceeds 1 V. This value is remarkably higher than a reduction potential in the case of reducing Ni(II) to Ni(0) and a reduction potential in the case of reducing Fe(II) to Fe(0) and the value can efficiently reduce various metal ions to cause deposition.

When Ti(III) functions as a reducing agent and is oxidized itself to Ti(IV), it reduces one or more metal ions in the same solution thereby to cause deposition in the solution. In the reaction solution, a lot of fine metal particles made of a simple substance of metal or an alloy are deposited. Also Ti(IV) inhibits rapid and nonuniform growth of the metal particles in the cluster. As a result, the deposited metal particles have high sphericity and a small primary particle diameter.

Furthermore, the deposited metal particles are bonded to the chain, while arranging in the direction corresponding to a magnetic field through the action of the magnetic field applied to the solution, for example, the direction along magnetic induction lines of the magnetic field, and thus a chain metal powder (A) or the chain metal powder (C) before coating the coating layer is formed.

In this case, since proximity between deposited metal particles, connection through a magnetic force and chain growth caused thereby are controlled by the action of the polymer compound (I) or (II), as the dispersing agent added in the solution, the resulting chain metal powder has a small distribution of the chain length.

Since the occurrence of branched chain and cohesion of plural chains are inhibited by the action of the polymer compound (I) or (II), the chain metal powder thus formed is linear without branches and is also excellent in linearity.

Moreover, since the reduction deposition reaction uniformly proceeds in the system, individual metal particles constituting the chain metal powder have a small distribution of the chain length and also particle diameter distribution of the primary particle diameter is sharp. Therefore, the chain metal powder thus formed also has a small distribution of thickness.

When the deposition is continued after forming the chain metal powder (A) in the solution, the metal layer is further deposited on the surface of the solution and the metal particles are firmly bonded. In other words, the chain metal powder (B) or the chain metal powder (D) before coating the coating layer is formed.

The intensity of the magnetic field to be applied to the solution is not specifically limited, but is preferably 5 mT or more in terms of magnetic flux density. When the magnetic field intensity is 5 mT or more, fine metal particles at the initial stage of the deposition can be arranged in the direction corresponding to the applied magnetic field as a result of overcoming of earth magnetism or resistance of the solution, and thus linearity of the chain metal powder can be further improved.

Taking account of the fact that the metal particles are arranged lineally as possible, the higher the magnetic field intensity, the preferable. Even if the intensity of the magnetic field is too high, not only additional effects are not expected, but also it becomes necessary to prepare a large-scale coil or permanent magnet requited to generate the magnetic field of high intensity. Therefore the intensity of the magnetic field to be applied is further preferably 8T or less.

The reduction deposition reaction is conducted to maintain a stationary condition of the reaction solution substantially without stirring after terminating a flow of the reaction solution by rotating a stirring bar used when preparing the reaction solution by mixing the above respective solutions several times in the reverse direction. More specifically, it is preferred to conduct the reduction deposition reaction at a stirring rate of 0.1 rpm or less, more preferably 0 rpm. When the reduction deposition reaction is conducted under the above conditions, influence of stress due to stirring on the metal particles deposited in the solution or the chain bonded with the metal particles is prevented and linearity of the chain metal powder is improved, and also break of the bonded chains due to the stress or bonding of plural chains are prevented and thus distribution of the chain length can be prevented.

The solution remained after the production of the chain metal powder can be used repeatedly in the production of the chain metal powder by the reduction deposition process by the electrolytic regeneration, as described above. When the solution remained after the production of the chain metal powder is subjected to an electrolysis treatment thereby to reduce a part of Ti(IV) to Ti(III), it can be used again as an aqueous reducing agent solution. This is because Ti ions are hardly consumed during the reduction deposition, in other words, they are hardly deposited together with the metal to be deposited.

Ti ions as the reducing agent are supplied in the form of a water soluble salt such as titanium trichloride or titanium tetrachloride. Namely, titanium trichloride and titanium tetrachloride are added in an amount corresponding to a ratio of the contents of Ti (III) and Ti (IV) in the aqueous reducing agent solution, or only titanium tetrachloride is added and the solution is subjected to an electric field treatment in the same manner as in the regeneration of the solution remained after use, thereby to reduce a part of Ti (IV) to Ti (III), and then subjected to the reduction deposition reaction.

When the solution is regenerated, and when the solution containing only titanium tetrachloride added therein is subjected to the electric field treatment to prepare an initial aqueous reducing agent solution, the ratio of the contents of Ti(III) and Ti(IV) in the aqueous reducing agent solution can be optionally controlled, thereby making it possible to adjust functions of both, which conflict with each other, in the cluster, and thus the primary particle diameter of metal particles can be optionally controlled.

Examples of the complexing agent include carboxylic acid such as ethylenediamine, citric acid, tartaric acid, nitrilotriacetic acid or ethylenediaminetetraacetic acid, or sodium salt, potassium salt or ammonium salt thereof. Metal ions are supplied in the form of a water soluble salt of the metal. As the dispersing agent, a polymer compound (I) or (II) is used.

[Polymer Compound (I)]

The polymer compound (I) is composed a copolymer comprising:

(a) repeating units represented by the formula (1):

[Chemical Formula 7]

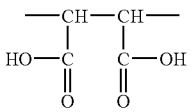

(1)

and (b) repeating units represented by the formula (2):

[Chemical Formula 8]

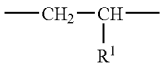

(2)

wherein $R^1$ represents an aromatic group which may have a substituent, or a cycloalkyl group.

In the polymer compound (I), hydrophilicity due to a hydrophilic moiety composed of the repeating units represented by the formula (1) and hydrophobicity due to a hydrophobic moiety composed of the repeating units represented by the formula (2) can be controlled by appropriately selecting the average molecular weight, the contents of both repeating units and the kind of the group $R^1$. Such a control changes the size in the case of covering metal particles deposited in the aqueous solution and appropriately control proximity between the metal particles, connection through a magnetic force and chain growth caused thereby to control the branching degree or chain length of the chain metal powder.

In the polymer compound (i), examples of the aromatic group corresponding to the group $R^1$ in the repeating units represented by the formula (2) include a phenyl group, 1-naphthyl group and 2-naphthyl group. Examples of the substituent, with which the aromatic group may be substituted, include alkyl groups having 1 to 4 carbon atoms, such as methyl, ethyl, n-propyl, i-propyl, n-butyl, i-butyl, s-butyl and t-butyl; and alkoxy groups having 1 to 4 carbon atoms, such as methoxy, ethoxy, propoxy and butoxy. The number of the substituent, which the aromatic group is substituted, can be optionally set within a range from 1 to 5 in case of a phenyl group, or set within a range from 1 to 7 in case of a 1- or 2-naphthyl group. Two or more substituents may be the same or different. Examples of the cycloalkyl group corresponding to the group $R^1$ include cycloalkyl groups having 3 to 6 carbon atoms, such as cyclopropyl, cyclobutyl, cyclopentyl and cyclohexyl.

The polymer compound (i) may contain, as the repeating units represented by the formula (2), two or more kinds of repeating units in which the group $R^1$ in the formula (2) is different.

The polymer compound (I) can further comprise:

(c) repeating units represented by the formula (3):

[Chemical Formula 9]

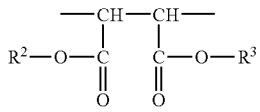

(3)

wherein $R^2$ and $R^3$ are the same or different and represent a hydrogen atom, an alkyl group which may have a substituent, a cycloalkyl group, an ammonium group or an alkali metal atom, provides that $R^2$ and $R^3$ are not simultaneously hydrogen atoms.

Although the repeating units represented by the formula (3) are hydrophilic similar to the repeating units represented by the formula (1), hydrophilicity can be finely adjusted by selecting the kind of the substituent. Therefore, selection of the content of the repeating units represented by the formula (3) and the kind of the substituents $R^2$ and $R^3$ makes it possible to adjust the balance between hydrophilicity and hydrophobicity in the polymer compound (I) more finely and to accurately control the number of branches and chain length of the chain metal powder.

Examples of the alkyl group corresponding to the substituents $R^2$ and $R^3$ include alkyl groups having 1 to 4 carbon atoms described above. Examples of the substituent, with which the alkyl group may be substituted, include alkoxy groups having 1 to 4 carbon atoms described above. Examples of the cycloalkyl group corresponding to the groups $R^2$ and $R^3$ include cycloalkyl groups having 3 to 6 carbon atoms described above. Examples of the alkali metal atom include Na and K.

When the polymer compound (I) contains the repeating units represented by the formula (3), the repeating units may contain two or more kinds of the repeating units in which the groups $R^2$ and $R^3$ in the formula (3) are different.

The polymer compound (I) is synthesized, for example, by a random or alternating copolymerization of maleic acid from which the repeating units represented by the formula (1) are derived, and a vinyl compound represented by the formula (21):

[Chemical Formula 10]

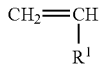

(21)

wherein $R^1$ represents an aromatic group which may have a substituent, or a cycloalkyl group, from which the repeating units represented by the formula (2) are derived.

The polymer compound (I) containing the repeating units represented by the formula (3) is synthesized by esterifying a part of carboxylic acid groups of the repeating units represented by the formula (1) in the molecule of the copolymer [when the group $R^2$ or $R^3$ is an alkyl group or a cycloalkyl group in the repeating units represented by the formula (3)], or reacting a part of the carboxylic acid groups with an alkali to form a salt [when the group $R^2$ or $R^3$ is an ammonium group or an alkali metal atom in the repeating units represented by the formula (3)].

Examples of the specific compound of the polymer compound (I) suited for the process of the present invention include, but are not limited to, various polymer compounds shown in Table 1. The descriptions in the respective columns in the table are as follows;

Average molecular weight: Symbols attached to the numerals in the column of the average molecular weight indicate (n): number average molecular weight and (w): weight-average molecular weight.

Repeating unit: Among the column of repeating units, "Anhydrous" in the column of the formula (1) indicates that two adjacent carboxylic acid groups in the repeating units represented by the formula (1) are dehydrated and condensed to form a dicarboxylic anhydride, and "(1)" indicates that a hydrolyzed state of the formula (1). It is based on supply of the polymer compound in a dry state or supply in the form of an aqueous solution whether or not the repeating units represented by the formula (1) are in the state of an anhydride. In other words, two carboxylic acid groups in the repeating units represented by the formula (1) are dehydrated and condensed to the state of an anhydride in the polymer compound (I) to be supplied in a dry state, while a hydrolyzed state of the formula (1) is maintained in the polymer compound (I) to be supplied in the form of an aqueous solution.

Even in the reaction solution of the reduction deposition reaction, since the reaction solution contains water, the repeating units represented by the formula (1) are in a hydrolyzed state of the formula (1). Therefore, in spite of the fact that the polymer compound (I) is supplied in the form of an anhydride or an aqueous solution, the repeating units represented by the formula (1) in the polymer compound (I), which are present in the environment where the reduction deposition reaction is conducted, are in the hydrolyzed state shown in the same formula. Therefore, in the present invention, it is defined that the reduction deposition reaction is conducted in the presence of the polymer compound (I) containing the repeating units represented by the formula (1).

Symbols attached to the numerals in the column of the content of the repeating units represented by the formula (2) in Table 1 indicate; (n): Number % of the repeating units represented by the formula (2) based on all the repeating units, and (w): Weight % of the repeating units represented by the formula (2) based on all the repeating units.

The symbol (–) in the column of the formula (3) indicates that the repeating units represented by the formula (3) are not present in the corresponding polymer compound. If the repeating units are present, the name of the substituent corresponding to the groups $R^2$ and $R^3$ are described. In the column, two kinds of groups described with a slush indicate that the repeating units represented by the formula (3) have two kinds of groups as the group $R^2$ and $R^3$.

All polymer compounds in the table are synthesized by the above method or a similar synthesis method and the groups $R^2$ and $R^3$ are introduced by the esterification reaction after copolymerizing maleic acid with a vinyl compound represented by the formula (21) (styrene in the each example of the table), or reacting with an alkali, and therefore the introduced state is not specified.

In case of the polymer compound (I-4) in the table, the repeating units represented by the formula (3) can be in one or more states of the state where both groups $R^2$ and $R^3$ are cyclohexyl groups in the same molecule, the state where both groups $R^2$ and $R^3$ are i-propyl groups in the same molecule, the state where one of the groups $R^2$ and $R^3$ is a cyclohexyl group and the other one is an i-propyl group, the state where one of the groups $R^2$ and $R^3$ is a cyclohexyl group and the other one is a hydrogen atom (nonsubstituted) and the state where one of the groups $R^2$ and $R^3$ is a i-propyl group and the other one is a hydrogen atom (nonsubstituted), and the state is not specified.

The same may be said of those having only one kind of group as the groups $R^2$ and $R^3$. In the case of the polymer compound (I-5) in the table, the repeating units represented by the formula (3) can be in one or more state of the state where both groups $R^2$ and $R^3$ are n-propyl groups in the same molecule and the state where one of the groups $R^2$ and $R^3$ is an n-propyl group and the other one is a hydrogen atom (nonsubstituted) and the state is not specified.

Furthermore, the column of the sequence indicates that maleic acid from which the repeating units represented by the formulas (1) and (3) are derived and a vinyl compound represented by the formula (21) from which the repeating units represented by the formula (2) are derived are subjected to random copolymerization ("random" in the table) or alternating polymerization ("alternating" in the table), and it is not specified into which position of the repeating units represented by the formula (1) the groups $R^2$ and $R^3$ are introduced by the esterification reaction or the reaction with an alkali, in other words, at which position repeating units represented by the formula (3) are not specified.

TABLE 1

| Polymer compound No. | Average molecular weight | Repeating units: Formula (1) | Formula (2): Content | Formula (2): $R^2$ | Formula (3) | Sequence |
|---|---|---|---|---|---|---|
| (I-1) | 1600 (n) | Anhydrous | 57% (n) | Phenyl | — | Random |
| (I-2) | 1700 (n) | Anhydrous | 68% (w) | Phenyl | — | Random |
| (I-3) | 1900 (n) | Anhydrous | 75% (w) | Phenyl | — | Random |
| (I-4) | 1700 (n) | Anhydrous | 63% (n) | Phenyl | Cyclohexyl/i-propyl | Random |
| (I-5) | 1900 (n) | Anhydrous | 67% (n) | Phenyl | n-propyl | Random |
| (I-6) | 2500 (n) | Anhydrous | 60% (n) | Phenyl | 2-butoxyethyl | Random |
| (I-7) | 65000 (w) | (1) | >50% (n) | Phenyl | i-butyl | Random |
| (I-8) | 180000 (w) | (1) | >50% (n) | Phenyl | i-butyl/methyl | Random |
| (I-9) | 225000 (w) | (1) | >50% (n) | Phenyl | i-butyl/methyl | Random |
| (I-10) | 105000 (w) | (1) | >50% (n) | Phenyl | s-butyl/methyl | Random |
| (I-11) | 350000 (w) | (1) | 50% (n) | Phenyl | Methyl | Alternating |
| (I-12) | 225000 (w) | (1) | 50% (n) | Phenyl | Na | Alternating |

[Polymer Compound (II)]

The polymer compound (II) is composed a copolymer comprising:

(d) repeating units represented by the formula (1):

[Chemical Formula 11]

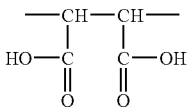

(1)

and (e) repeating units represented by the formula (4):

[Chemical Formula 12]

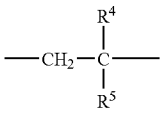

(4)

wherein $R^4$ and $R^5$ are the same or different and represent a hydrogen atom, or an alkyl group, provided that $R^4$ and $R^5$ are not simultaneously hydrogen atoms.

In the polymer compound (II), hydrophilicity due to a hydrophilic moiety composed of the repeating units represented by the formula (1) and hydrophobicity due to a hydrophobic moiety composed of the repeating units represented by the formula (4) can be controlled by appropriately selecting the average molecular weight, the contents of both repeating units and the kind of the groups $R^4$ and $R^5$. Such a control changes the size in the case of covering metal particles deposited in the aqueous solution and appropriately control proximity between the metal particles, connection through a magnetic force and chain growth caused thereby to control the branching degree or chain length of the chain metal powder.

In the polymer compound (II), examples of the alkyl group corresponding to the groups $R^4$ and $R^5$ in the repeating units represented by the formula (4) include alkyl groups having 1 to 4 carbon atoms described in the polymer compound (I). The polymer compound (II) may contain, as the repeating units represented by the formula (4), two or more kinds of repeating units in which the groups $R^4$ and $R^5$ in the formula (4) are different.

The polymer compound (II) can further comprise:

(f) repeating units represented by the formula (5):

[Chemical Formula 13]

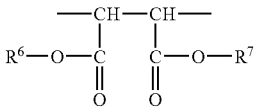

(5)

wherein $R^6$ and $R^7$ are the same or different and represent a hydrogen atom or an ammonium group, provided that $R^6$ and $R^7$ are not simultaneously hydrogen atoms.

Although the repeating units represented by the formula (5) are hydrophilic similar to the repeating units represented by the formula (1), hydrophilicity can be finely adjusted by selecting the kind of the substituent. Therefore, selection of the content of the repeating units represented by the formula (5) and the substituents $R^6$ and $R^7$ makes it possible to adjust balance between hydrophilicity and hydrophobicity in the polymer compound (II) more finely and to accurately control the number of branches and chain length of the chain metal powder.

When the polymer compound (II) contains repeating units represented by the formula (5), the repeating units may contain two or more kinds of repeating units in which the groups $R^6$ and $R^7$ in the formula (5) are different.

The polymer compound (II) is synthesized, for example, by a random or alternating copolymerization of maleic acid from which repeating units represented by the formula (1) are derived, and a vinyl compound represented by the formula (41):

[Chemical Formula 14]

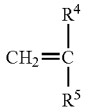

(41)

wherein $R^4$ and $R^5$ are the same or different and represent a hydrogen atom or an alkyl group, provided that $R^4$ and $R^5$ are not simultaneously hydrogen atoms, from which repeating units represented by the formula (4) are derived.

The polymer compound (II) also containing the repeating units represented by the formula (5) is synthesized by reacting a part of carboxylic acid groups of the repeating units represented by the formula (1) in the molecule of the copolymer to form an ammonium salt [the repeating units represented by the formula (5) are formed].

Specific examples of the polymer compound (II) suited for the process of the present invention include, but are not limited to, a polymer compound (II-1) having a weight-average molecular weight of 165500 and the content of the repeating units represented by the formula (4) of 50% in terms of the number %, which is obtained by alternating copolymerization of maleic acid and isobutylene in which both groups $R^4$ and $R^5$ in the formula (41) are simultaneously methyl groups, reacting a part of carboxylic acid groups in the repeating units represented by the formula (1) with ammonia to form an ammonium salt [the repeating units represented by the formula (5) are formed] and drying the residual carboxylic acid groups to form a anhydrous carboxylic acid groups.

The introduction state of the groups $R^6$ and $R^7$ in this polymer compound (II-1) is not specified by the same reason as in the case of the polymer compound (I). That is, the repeating units represented by the formula (5) can be in one or more states of the state where both groups $R^6$ and $R^7$ are ammonium groups in the same molecule and the state where one of the groups $R^6$ and $R^7$ is an ammonium group and the other one is a hydrogen atom (nonsubstituted), and the state is not specified. It is not also specified into which position the groups $R^6$ and $R^7$ are introduced by the reaction with ammonia, in other words, at which position the repeating units represented by the formula (5) are not specified.

The solution preferably contains the polymer compound (I) or (II) as the dispersing agent in the amount within a range from 0.5 to 100 parts by weight based on 100 parts by weight of the chain metal powder to be deposited. To further improve the effect of inhibiting the occurrence of branches and nearly arranging the chain length within a fixed range, due to the addition of the polymer compound (I) or (ii), the content is particularly preferably 5 parts by weight or more based on 100 parts by weight of the chain metal powder. Taking account of the fact that smooth formation of linear bonding of the metal particles deposited in the solution is promoted by preventing viscosity of the solution from increasing too high, the amount of the polymer compound (I) or (II) is particularly preferably 50 parts by weight or less based on 100 parts by weight of the chain metal powder.

As described above, the chain metal powder produced by the process of the present invention can be suitably used as a conductive component of an anisotropic conductive film by making use of linearity or uniformity of the chain length, and also can be used as a conductive component of anisotropic electromagnetic wave shielding members and light transmitting electromagnetic wave shielding members.

<<Process for Production of Chain Metal Powder and Chain Metal Powder>>

As described above, the process for production of a chain metal powder of the present invention, which comprises the steps of reducing ferromagnetic metal ions contained in an aqueous solution through the action of a reducing agent while applying a magnetic field to the solution in a fixed direction thereby to deposit fine metal particles, and bonding a lot of the fine metal particles in a chain form so as to orient the fine metal particles in a direction of the applied magnetic field through magnetism of the fine metal particles, characterized in that the reduction deposition reaction is conducted in the presence of:

(g) a reducing agent for generating a gas during the reduction of metal ions, or a combination of the reducing agent and a foaming agent capable of generating a gas; and (h) a foamable water soluble compound for generating a bubble layer on the surface of the aqueous solution, by generating of the gas and the bubble layer formed on the surface of the aqueous solution is separated from the aqueous solution and then the chain metal powder contained in the bubble layer is collected.

[Chain Metal Powder]

Examples of the chain metal powder of the present invention include, for example, the above-described (A) to (F) alone or a mixture of two or more kinds of them.

[Reducing Agent]

The reducing agent used in the process of the present invention may be any of various reducing agents having a function of reducing metal ions in the aqueous solution thereby to deposit metal particles, and is particularly preferably a reducing agent capable of generating a gas in the case of reducing metal ions. Examples of such a reducing agent include various reducing agents described below, and the above-described Ti(III) clustered with Ti(IV) is preferable.

[a] Ti(III) Clustered with Ti(IV)

In the case of reducing metal ions, water is reduced to generate a hydrogen gas. Other advantages of the use of Ti(III) clustered with Ti(IV) as the reducing agent are as described above.

[b] Hypophosphites

Sodium hypophosphite, etc. In the case of reducing metal ions, water is reduced to generate a hydrogen gas. During the reduction deposition, since the material is contaminated with phosphorus as impurities, a nonmagnetic phosphorus compound ($Ni_3P$) is formed especially in the case of Ni and saturation magnetization of the metal particles may deteriorate. However, in the case of a metal having a large saturation magnetization in a bulk material, such as an Fe or Fe—Co alloy, a chain metal powder can be produced by bonding a lot of the metal particles, through the magnetism, while orienting in the direction of an applied magnetic field.

[c] Boron Hydride Compound

Dimethylaminoborane, etc. In the case of reducing metal ions, water is reduced to generate a hydrogen gas. During the reduction deposition, since the material is contaminated with boron as impurities, saturation magnetization of metal particles may deteriorate especially in the case of Ni. However, in the case of a metal having a large saturation magnetization in a bulk material, such as an Fe or Fe—Co alloy, a chain metal powder can be produced by bonding a lot of the metal particles, through the magnetism, while orienting in the direction of an applied magnetic field.

[d] Hydrazine

In the case of reducing metal ions, water is reduced to generate a hydrogen gas. Since the deposited metal particles do not contain a component as impurities, a high purity chain metal powder can be produced. Therefore, even in the case of a metal having a small saturation magnetization in a bulk material, such as Ni, a chain metal powder can be produced by bonding a lot of the metal particles, through the magnetism, while orienting in the direction of an applied magnetic field.

As the reducing agent, for example, polyols such as ethylene glycol as well as a reducing agent, which does not generate a gas in the case of reducing metal ions, can also be used. In that case, a low boiling point alcohol may be used in combination as a foaming agent capable of generating a gas, in addition to the reducing agent, and the alcohol may be vaporized by heat during the reaction thereby to generate a gas.

[Foamable Water Soluble Compound]

As a foamable water soluble compound, which forms a stable bubble layer on the surface of the aqueous solution through generation of a gas, various foamable water soluble compounds can be used. Among dispersing agents having the function of covering the deposited metal particles and the chain metal powder, foamable dispersing agents are preferably selected and used.

By using a foamable dispersing agent, the cost of the process for production of the chain metal powder can be reduced as compared with the case of using the foamable water soluble compound in combination with the dispersing agent. When the chain is formed by bonding a lot of deposited metal particles deposited by the reduction deposition reaction so as to orient in the direction of a magnetic field, and covered with the dispersing agent, the dispersing agent inhibits the occurrence of branching in the chain and cohesion of plural chains. Therefore, it is made possible to produce a nearly linear chain metal powder containing few branches as compared with the case where a magnetic field is merely applied. The chain metal powder thus produced is made to be hydrophobic as is covered with a dispersing agent and affinity to bubbles of a gas is improved as compared with water, and thus the chain metal powder adheres to bubbles and is carried to the bubble layer with ease. Therefore, collection efficiency of the chain metal powder having a short chain length contained in the bubble layer can be improved.

Examples of the foamable dispersing agent include the following various dispersing agents. Weight % of the styrene content and the isobutylene content are weight % of corresponding repeating units based on all repeating units and number % is number % of corresponding repeating units based on all repeating units.

(i) Styrene-maleic anhydride random copolymer [number average molecular weight: 1700, styrene content: 68% by weight, polymer compound (I-2) in Table 1]

(ii) Partial ammonium salt compound of isobutylene-maleic anhydride alternating copolymer [weight-average molecular weight: 165500, isobutylene content: 50 number %, polymer compound (II-1)]

(iii) CELUNA D-735 [trade name of CHUKYO YUSHI CO., LTD., mixture of a styrene-maleic acid copolymer (weight-average molecular weight: 19000) as an active ingredient, ammonia and water]

Even when a unfoamable dispersing agent is used in combination with a foamable water soluble compound, the cost reduction effect is not obtained, but the same effects can be obtained, except for the cost reduction effect. Examples of the unfoamable dispersing agent include the following various dispersing agents. The styrene content is the same as described above. Examples of the foamable water soluble compound used in combination with the unfoamable dispersing agent include various soap-based surfactants.

(iv) Styrene-maleic anhydride random copolymer [number average molecular weight: 1900, styrene content: 75% by weight, polymer compound (I-3) in Table 1]

(v) Partially esterified product of styrene-maleic anhydride random copolymer [number average molecular weight: 1900, styrene content: 67 number %, n-propyl ester, polymer compound (I-5) in Table 1]

(vi) Partially esterified product of styrene-maleic acid random copolymer [weight-average molecular weight: 65000, styrene content: more than 50%, i-butyl ester, polymer compound (I-7) in Table 1]

Among the above-described various dispersing agents, dispersing agents (i), (ii), (iv), (v) and (vi) have the effect of covering metal particles deposited in the aqueous solution, thereby to satisfactorily control proximity between the metal particles, connection due to magnetism and chain growth caused thereby, and to produce a chain metal powder which has a small distribution of the chain length, as described above. Therefore, when using these dispersing agents, collection efficiency of a chain metal powder having a short chain length contained in the bubble layer can be further improved.

In both cases of a foamable dispersing agent and a unfoamable dispersing agent, the reaction solution may contain the dispersing agent in the amount within a range from of 0.5 to 100 parts by weight based on 100 parts by weight of the chain metal powder to be deposited. To further improve the effect of inhibiting the occurrence of branching due to the addition of the dispersing agent, hydrohobing the chain metal powder and nearly arranging the chain length within a fixed range, the content of the dispersing agent is more preferably 5 parts by weight or more based on 100 parts by weight of the chain metal powder. Taking account of the fact that smooth formation of linear bonding of metal particles deposited in the solution is promoted by preventing viscosity of the solution from increasing too high, the amount of the dispersing agent is particularly preferably 50 parts by weight or less based on 100 parts by weight of the chain metal powder.

[Production of Chain Metal Powder]

In an example of the embodiment of the process for production of a chain metal powder of the present invention in which Ti(III) clustered with Ti(IV) having the function of generating a gas in the case of reducing metal ions is used as the reducing agent, as described above, first, <1> an aqueous metal ion solution containing one or more metal ions constituting metal particles and a complexing agent, <2> an aqueous reducing agent solution containing Ti(III) and Ti(IV), and <3> an aqueous dispersing agent solution containing a foamable dispersing agent, or a unfoamable dispersing agent and a foamable water soluble compound, and ammonia or the like asa a pH adjustor, are separately prepared.

When an aqueous dispersing agent solution is added to a reaction mother solution prepared by adding and mixing an aqueous reducing agent solution to the aqueous metal ion solution, while applying a magnetic field in a fixed direction, and the pH is adjusted within a range from 9 to 10 to prepare a reaction solution, a chain metal powder is produced with the above-described reaction mechanism in this reaction solution.

The chain metal powder thus produced is contacted with bubbles of a hydrogen gas generated by reducing water in the case of oxidizing Ti(III) to Ti(IV). As a result, the chain metal powder becomes hydrophobic by being covered with the dispersing agent and affinity to bubbles of a gas is improved as compared with water, and thus the chain metal powder adheres onto the surface of the bubbles.

A light chain metal powder having a comparatively short chain length is carried onto the surface of the reaction solution with the rise of bubbles and then accumulated on the bubble layer formed on the surface, while a heavy chain metal powder having a comparatively long chain length falls off from the bubbles during rising even if it adheres onto the bubbles to prevent the rise of the bubbles, and thus the heavy chain metal powder is remained in the reaction solution.

Therefore, when the bubble layer is separated from the solution and the chain metal powder contained in the bubble layer is collected, it is possible to produce a chain metal powder which has a small distribution of the chain length having a short chain length. When the chain metal powder remained in the reaction solution is collected, the component having a short chain length is removed, thus making it possible to obtain a chain metal powder which has a small distribution of the chain length having a long chain length.

The conditions of the reduction deposition reaction, for example, intensity of the magnetic field to be applied to the reaction solution may be the same as those described above. After the completion of the reaction, the reaction solution is not preferably stirred, as described above. The following facts are also as described above: When the solution remained after the production of the chain metal powder is electrolytically regenerated, it can be repeatedly used as the aqueous reducing agent solution; and also a ratio of the contents of Ti(III) and Ti(IV) in the aqueous reducing agent solution can be optionally adjusted by adjusting the conditions of the electrolysis treatment. Examples of the complexing agent include various compounds described above.

As described above, the chain metal powder produced by the process of the present invention can be suitably used as a conductive component of an anisotropic conductive film by making use of linearity or uniformity of the chain length, and also can be used as a conductive component of anisotropic electromagnetic wave shielding members and light transmitting electromagnetic wave shielding members.

<Anisotropic Conducting Film>>

The anisotropic conductive film of the present invention is characterized in that the chain metal powder of the present invention having a chain length less than the distance between the adjacent electrodes within the same surface is contained in the film in the state where the powders are oriented in the thickness direction of the film, as described above.

(Chain Metal Powder)

As the chain metal powder, for example, there can be used various chain metal powders which has a feature of the above-described chain metal powder of the present invention and also has a chain length within the above range, particularly a chain length adjusted to the length 0.9 times less than the distance between adjacent electrodes.

To adjust the chain length of the chain metal powder within the above range, there may be employed a process of adjusting the kind or content of a dispersing agent such as polymer compound (I) or (II) which is contained in the solution in the case of producing the chain metal powder by the reductive deposition process.

However, when the chain length is too short, a network of high electrical conductivity may not be formed even in the case of being oriented in the thickness direction of the film, and also connection resistance in the thickness direction of the film may not be sufficiently decreased. Therefore, the chain length is more preferably more than a distribution of height of plural electrodes constituting the connection section for conductive connection.

Taking account of a satisfactory orientation in the thickness direction of the film, the chain metal powder preferably has a ferromagnetism so as to be oriented with ease by applying a magnetic field. To obtain such a chain metal powder, any one of constitutions (A) to (D) described above is preferably employed.

Taking account of the fact that the network of high electrical conductivity is formed in the thickness direction of the film thereby to further decrease the connection resistance in the same direction, the chain metal powder preferably has a coating layer made of a metal having an excellent conductivity or an alloy thereof. To obtain such a chain metal powder, constitutions (C) and (D) among the above-described constitutions are employed more preferably. As is apparent from the results of examples and comparative examples described hereinafter, even in the case of a chain metal powder having simple structures (A) and (B) with no coating layer, it is possible to decrease a connection resistance in the thickness direction of the film to the range suited for practical use.

(Binder)

As the binder, which forms an anisotropic conductive film together with the chain metal powder, there can be used various compounds having film forming properties and adhesion, which have conventionally been known as the binder in these uses. Examples of the binder include thermoplastic resins, curable resins and liquid curable resins, and acrylic resins, epoxy resins, fluorine resins and phenol resins are particularly preferable.

(Anisotropic Conducting Film and Process for Production Thereof)

It is necessary that the anisotropic conductive film of the present invention is fixed in the state where the chain of the chain metal powder is oriented in the thickness direction of the film, as described above. The anisotropic conductive film can be produced by:

<i> a process of coating a composite material prepared by mixing a chain metal powder with a binder in a predetermined ratio, together with a proper solvent, onto a substrate to which a magnetic field is applied in the direction intersecting with the substrate surface, and solidifying or curing the composite material in the state where the chain metal powder is oriented in the thickness direction of the film along the direction of the magnetic field thereby to fix the orientation of the chain metal powder; or <ii> a process of scattering a chain metal powder on a substrate to which a magnetic field is applied in the direction intersecting with the substrate surface, coating a flowable coating agent containing a binder in the state where the chain metal powder is oriented in the thickness direction of the film, solidifying or curing the coating agent thereby to fix the orientation of the chain metal powder, and removing the resulting anisotropic conductive film from the substrate. The solvent may be omitted by using a liquid binder such as liquid curable resin in the composite material used in the process <i> or the coating agent used in the process <ii>.

The intensity of the magnetic field to be applied in the case of conducting the processes <i> and <ii> varies depending on the kind or content of a metal having a ferromagnetism contained in the chain metal powder, but is preferably 1 mT or more, more preferably 10 mT or more, and particularly preferably 40 mT or more, in terms of magnetic flux density taking account of sufficiently orienting the chain metal powder in the anisotropic conductive film in the thickness direction of the film.

Examples of the process of applying the magnetic field include a process of disposing a magnet on or under a substrate such as glass substrate or plastic substrate, or a process of utilizing the surface of a magnet as the substrate. The latter process utilizes the fact that a line of a magnetic force emitted from the surface of the magnet is nearly perpendicular to the surface of the magnet in the range from the surface to the thickness of the anisotropic conductive film or less, and there is an advantage that an apparatus for the production of an anisotropic conductive film can be simplified.

The content ratio of the chain metal powder in the resulting anisotropic conductive film of the present invention is preferably within a range from 0.05 to 20% by volume. The thickness is preferably within a range from 10 to 100 μm taking account of a satisfactory conductive adhesion in the case of contact bonding of an electrode and a bump electrode, or an electrode and an electrode via an anisotropic conductive film.

The anisotropic conductive film of the present invention does not cause short circuiting because of the function of the chain metal powder as the conductive component even if a pitch between adjacent electrodes is less than 50 μm, and preferably 40 μm or less, in mounting of a semiconductor package. Therefore, it becomes possible to sufficiently meet the requirements of higher density mounting. In addition to the above applications, the anisotropic conductive film of the present invention can be used for pin mounting of IC sockets. It is also possible to use the anisotropic film for the three-dimensional package connected by wire bonding or μ BGA (μ ball grid array) connection at present.

EXAMPLES

The present invention will now be described by way of examples and comparative examples.

<<Production of Chain Metal Powder>>

Example 1 to 13

In 715 ml of pure water, 91.5 g (0.30 mols) of trisodium citrate dihydrate and 11.0 g (0.04 mols) of nickel sulfate hexahydrate were dissolved to prepare an aqueous metal ion solution. An aqueous reducing agent solution was prepared by the following procedure. That is, an aqueous 20 wt % hydrochloric acid solution (pH4) of titanium tetrachloride was poured into one cell of a two-cell type electrolytic cell partitioned with an anion exchange membrane produced by Asahi Glass Co., Ltd. and an aqueous sodium sulfate solution having a mol concentration of 0.1 M was poured into the other cell. After dipping a carbon felt electrode in each solution, the aqueous solution was subjected to a cathodic electrolysis treatment by electrifying with DC current while controlling to a fixed voltage of 3.5 V employing the side of the aqueous titanium tetrachloride solution as a cathode and the side of the aqueous sodium sulfate solution as an anode, thereby reducing a part of Ti(IV) to Ti(III) to obtain 80.0 g of a solution. The total amount of titanium ions was 0.1 mols and a molar ratio of Ti(III) to Ti(IV) was 4:1.

Furthermore, 60.0 ml of 25% ammonia water and a polymer compound (I) or (II) in the amount shown in Table 2 were dissolved in pure water and, if necessary, pure water was added to make the amount 200 ml in total, and thus an aqueous dispersing agent solution was prepared. When using the polymer compound supplied in the form of a solid, the total amount of the polymer compound was previously dissolved in pure water at 50° C. and, if necessary, insolubles were removed by filtration to obtain a solution, and then the resulting solution was added so that the amount of each component is within the above range. When using the polymer compound supplied in the form of an aqueous solution, the amount was adjusted so that the amount of the solid content in the aqueous solution, that is, the amount of the polymer compound becomes a predetermined amount. The amount of ammonia water was controlled to the amount suited for adjusting the pH of the entire reaction solution to 10.

The whole amount of the aqueous metal ion solution was mixed with the whole amount of the aqueous reducing agent solution and, after stirring at 23±1° C. for 20 minutes, the mixed solution was charged in a reaction vessel arranged between a pair of opposing magnets. A magnetic field of 100 mT was continuously applied to the solution and also the whole amount of the aqueous dispersing agent solution heated previously to 35° C. was added at a time, while stirring the solution in the reaction vessel 4 to 5 times, using a stirring bar in the state where the liquid temperature is maintained at 35° C. to prepare a reaction solution having the pH adjusted to 10. After terminating a flow of the reaction solution by rotating the stirring bar 1 to 2 times in the reverse direction, the reduction deposition reaction was conducted by maintaining a stationary condition of the solution substantially without stirring (stirring rate: 0 rpm).

After 10 minutes from terminating the flow of the reaction solution, the precipitate in the solution was filtered and washed with water on a filter. Then a chain metal powder is produced by the steps of washing the precipitate in pure water with stirring (20 minutes), removing by filtration, washing in ethanol with stirring (30 minutes), ultrasonic washing in ethanol (30 minutes), removing by filtration and vacuum-drying (23±1° C.)

Comparative Example 1

In the same manner as in Examples 1 to 13, except that polyacrylic acid having a weight-average molecular weight of 2500 was used as a dispersing agent, a chain metal powder was produced.

Comparative Example 2

In the same manner as in Examples 1 to 13, except that a polymer compound having a weight-average molecular weight of 165500 obtained by an alternating copolymerization of isobutylene and maleic acid was used as a dispersing agent, a chain metal powder was produced.

Characteristics of the chain metal powders produced in the above respective examples and comparative examples were evaluated by the following shape evaluation test I.

Shape Evaluation Test I

After each of the chain metal powders produced in the examples and comparative examples was ultrasonic-dispersed in methyl ethyl ketone for 10 minutes, the resulting dispersion was maintained in a stationary condition thereby to precipitate the chain metal powder, remove the supernatant fluid (methyl ethyl ketone), and then 10.0 g of ACRYSIRUP SY-105 [trade name of Kanae Co., Ltd.] and 0.4 g of 2,2'-azobis(isobutyronitrile) were mixed based on 0.01 g of the chain metal powder.

The resulting mixture was uniformly dispersed by a centrifugal stirring for 10 minutes and defoaming for 10 minutes to prepare a liquid composite material for shape evaluation. The resulting composite material was coated onto a glass plate using a doctor knife (gap: 25 μm) and dried with heating at 100° C. for 30 minutes, and then the resin was cured to obtain a film for shape evaluation in which the chain metal powder is oriented in a plane direction of the film.

Microscopic images of the surface of the resulting film was taken into a computer using a CCD camera connected to a microscope. Image analysis was conducted by the computer and the chain length of all chain metal powders imaged was measured. An average chain length and a maximum chain length of the chain metal powder were determined from the measurement results and a ratio of maximum chain length/average chain length was calculated. As the average chain length, a number-average chain length was employed. As the maximum chain length, there employed a chain length in which a cumulative frequency integrated from the short chain length is 99% in number frequency distribution of the chain length.

From the ratio of maximum chain length/average chain length, it was evaluated according to the following criteria whether or not the chain length is within a fixed range.

BAD: impossible to evaluate the chain length because the number frequency distribution of the chain length does not only have single variation FAIR: maximum chain length/average chain length>4

GOOD: 4=maximum chain length/average chain length>3.0

EXCELLENT: 3.0=maximum chain length/average chain length

The results are shown in Table 2.

TABLE 2

| | Dispersing agent | | Evaluation | Average | Maximum | Maximum/ | |
|---|---|---|---|---|---|---|---|
| | Type | Amount (g) | number | (μm) | (μm) | Average | Evaluation |
| Example 1 | (I-1) | 1.0 | 277 | 20.1 | 85.4 | 4.2 | FAIR |
| Example 2 | (I-2) | 1.0 | 1098 | 2.5 | 7.1 | 2.8 | EXCELLENT |
| Example 3 | (I-8) | 1.0 | 432 | 13.1 | 49.0 | 3.7 | GOOD |
| Example 4 | (I-9) | 1.0 | 945 | 5.7 | 18.7 | 3.3 | GOOD |
| Example 5 | (I-10) | 1.0 | 171 | 15.3 | 64.1 | 4.2 | FAIR |
| Example 6 | (I-11) | 1.0 | 345 | 14.6 | 63.1 | 4.3 | FAIR |
| Example 7 | (I-12) | 1.0 | 185 | 14.3 | 63.1 | 4.4 | FAIR |
| Example 8 | (I-3) | 0.3 | 1077 | 3.8 | 10.3 | 2.7 | EXCELLENT |
| Example 9 | (I-4) | 0.3 | 1100 | 3.3 | 11.6 | 3.5 | GOOD |

TABLE 2-continued

| | Dispersing agent | | Evaluation | Average | Maximum | Maximum/ | |
|---|---|---|---|---|---|---|---|
| | Type | Amount (g) | number | (μm) | (μm) | Average | Evaluation |
| Example 10 | (I-5) | 0.3 | 1563 | 1.9 | 4.7 | 2.5 | EXCELLENT |
| Example 11 | (I-6) | 0.3 | 1852 | 1.9 | 7.8 | 4.1 | FAIR |
| Example 12 | (I-7) | 0.3 | 1766 | 1.6 | 4.8 | 3.0 | EXCELLENT |
| Example 13 | (II-1) | 1.0 | 1051 | 3.3 | 8.3 | 2.5 | EXCELLENT |
| Comparative Example 1 | PA | 1.0 | — | — | — | — | BAD |
| Comparative Example 2 | IB-MA | 1.0 | — | — | — | — | BAD |

PA: Polyacrylic acid
IB-MA: Alternating copolymer of isobutylene and maleic acid From the results shown in Table 2, since the chain length of all the chain metal powders of the respective examples produced by using the polymer compounds (I) or (II) as the dispersing agent could be evaluated because the number frequency distribution of the chain length has single variance, it was confirmed that the chain metal powders have a small distribution of the chain length.

<<Production of Anisotropic Conductive Film>>

Example 14

Two kinds of solid epoxy resins [article number: 6099 (referred to as a resin A) and 6144 (referred to as a resin B), produced by Asahi Kasei Corporation] and a microcapsule type latent curing agent [article number: HX3721 (referred to as a curing agent), produced by Asahi Kasei Corporation] were dissolved in a solvent mixture of butyl acetate and methyl isobutyl ketone in a weight ratio of 75/25, in a weight ratio, resin A/resin B/curing agent of 70/30/40, to prepare a resin solution in which the total concentration of three components of the resin A, the resin B and the curing agent is 40% by weight.

The resulting resin solution was mixed with the chain metal powder produced in Example 10 in a content ratio of 0.5% by volume and stirred uniformly using a centrifugal stirring mixer to prepare a liquid composite material for an anisotropic conductive film.

After the composite material was coated onto a PET film using a doctor knife, the solvent was removed by drying with heating at 80° C. for 5 minutes then at 100° C. for 10 minutes, while applying a magnetic field of 40 mT and the resin was preliminaly cured to produce a 40 μm thick anisotropic conductive film in which chain metal powders are fixed in the state of being oriented in the thickness direction of the film.

Comparative Example 3

In the same manner as in Example 14, except that the same amount of a conventional chain metal powder produced in Comparative Example 1 was used, a 40 μm thick anisotropic conductive film was produced.

Measurement of Connection Resistance

On an electrode pattern formed by arranging Au electrodes measuring 15 μm in width, 50 μm in length and 2 μm in thickness at intervals of 15 μm of FPC having the electrode pattern, each of the anisotropic conductive film produced in the example and comparative example was overlaid, and then they are temporarily bonded by applying a pressure of 0.1 $N/mm^2$ while heating to 80° C. for 10 seconds. On an anisotropic conductive film, a glass substrate in which an Al film was deposited on one surface was overlaid so as to contact the Al film with the anisotropic conductive film, and then they were finally bonded by applying a pressure of 3 $N/mm^2$ while heating to 200° C. A resistance value between two adjacent Au electrodes connected conductively via the anisotropic conductive film and the Al film was measured and a connection resistance in the thickness direction of the anisotropic conductive film was determined by reducing the measured value to half.

Measurement of Insulation Resistance

On an electrode pattern formed by arranging Au electrodes measuring 15 μm in width, 50 μm in length and 2 μm in thickness at intervals of 15 μm of FPC having the electrode pattern, each of the anisotropic conductive film produced in the example and comparative example was overlaid, and then they are temporarily bonded by applying a pressure of 0.1 $N/mm^2$ while heating to 80° C. for 10 seconds. On an anisotropic conductive film, a glass substrate in which no Al film was deposited was overlaid, and then they were finally bonded by applying a pressure of 3 $N/mm^2$ while heating to 200° C. A resistance value between two adjacent Au electrodes connected conductively via the anisotropic conductive film was measured and was taken as an insulation resistance in the plane direction of the anisotropic conductive film.

The results are shown in Table 3.

TABLE 3

| | Connection resistance (Ω) | Insulation resistance (GΩ) |
|---|---|---|
| Example 14 | 0.1 | 100 |
| Comparative Example 3 | 0.1 | 1 |

From the results shown in Table 3, it was confirmed that, according to the anisotropic conductive film of Example 14 in which the chain metal powder of the present invention was used, the insulation resistance in the plane direction of the film can be increased by preventing short circuiting due to falling down of the chain metal powder while maintaining the connection resistance in the thickness direction of the film at the same value, as compared with the anisotropic conductive film of Comparative Example 3 in which a conventional chain metal powder was used.

<<Production of Chain Metal Powder>>

Example 15

In pure water, 60.0 ml of 25% ammonia water and 1.0 g of CELUNA D-735 were dissolved and, if necessary, pure water was added to make the amount 200 ml in total, and thus an aqueous dispersing agent solution was prepared. The amount of ammonia water was controlled to the amount suited for adjusting the pH of the entire reaction solution to 10.

The whole amount of the same aqueous metal ion solution as that prepared in Example 1 was mixed with the whole amount of the same aqueous reducing agent solution as that prepared in Example 1. After stirring at 23±1° C. for 20 minutes, the mixed solution was charged in a reaction vessel arranged between a pair of opposing magnets. A magnetic field of 100 mT was continuously applied to the solution and also the total amount of the aqueous dispersing agent solution heated previously to 35° C. was added at a time, while stirring the solution in the reaction vessel 4 to 5 times, using a stirring bar in the state where the liquid temperature is maintained at 35° C. to prepare a reaction solution having the pH adjusted to 10. After terminating a flow of the reaction solution by rotating the stirring bar 1 to 2 times in the reverse direction, the reduction deposition reaction was conducted by maintaining a stationary condition of the solution substantially without stirring (stirring rate: 0 rpm). As a result, much bubbles were generated in the solution and almost all of them were remained without being broken on the surface of the solution to form a stable bubble layer on the surface of the reaction solution.

After 10 minutes from terminating the flow of the reaction solution, the bubble layer was separated from the solution, washed with water on a filter paper and then solid content was obtained. Then a chain metal powder is produced by the steps of washing the solid content in pure water with stirring (20 minutes), removing by filtration, washing in ethanol with stirring (30 minutes), ultrasonic washing in ethanol (30 minutes), removing by filtration and vacuum-drying (23±1° C.)

Example 16

In pure water, 60.0 ml of 25% ammonia water, 0.6 g of the polymer compound (I-7) as a unfoamable dispersing agent and 1.0 g of a partial ammonium salt compound of an isobutylene-maleic acid alternating copolymer as a foamable water soluble compound [weight-average molecular weight: 60000, isobutylene content: 50% by number] were dissolved and, if necessary, pure water was added to make the amount 200 ml in total, and thus an aqueous dispersing agent solution was prepared. In the same manner as in Example 15, except that this aqueous dispersing agent solution was used, the reduction deposition reaction was conducted, and then a stable bubble layer formed on the surface of the reaction solution was separated from the solution, to produce a chain metal powder by the same treatment in the same manner as in Example 15.

Comparative Example 4

In the same manner as in Example 15, except that a solid content was obtained on a filter paper by filtering with the reaction solution without separating the bubble layer, a chain metal powder was produced.

Characteristics of the chain metal powders produced in the above respective examples and comparative example were evaluated by the following shape evaluation test II.

Shape Evaluation Test II

With respect to each of the chain metal powders produced in the examples and comparative example, the same operation as in the case of the shape evaluation test I was conducted to produce a film for shape evaluation in which the chain metal powder is oriented in a plane direction of the film. Microscopic images of the surface of the resulting film was taken into a computer using a CCD camera connected to a microscope and then the image analysis was conducted by the computer.

The chain length of all chain metal powders imaged was measured. An average chain length and a maximum chain length of the chain metal powder were determined from the measurement results and a ratio of maximum chain length/average chain length was calculated. As the average chain length, a number-average chain length was employed. As the maximum chain length, there employed a chain length in which a cumulative frequency integrated from the short chain length is 99% in number frequency distribution of the chain length.

From the number frequency distribution, a frequency (% by number) in which a chain metal powder having the chain length of more than 10 μm is present was determined. When the frequency is small, the resulting chain metal powder does not contain a component having a long chain length. When the ratio of maximum chain length/average chain length is small, the resulting chain metal powder has a small distribution of the chain length having a short chain length.

From the ratio of maximum chain length/average chain length, it was evaluated according to the following criteria whether or not the chain length is within a fixed range.

BAD: impossible to evaluate the chain length because the number frequency distribution of the chain length does not only have single variation FAIR: maximum chain length/average chain length>4

GOOD: 4=maximum chain length/average chain length>3.0

EXCELLENT: 3.0=maximum chain length/average chain length

The results are shown in Table 4.

TABLE 4

| | Origin from which chain metal powder is collected | Evaluation number | Chain length: Average (μm) | Chain length: Maximum (μm) | Chain length: Maximum/Average | Frequency of component having chain length of more than 10 μm (%) | Evaluation |
|---|---|---|---|---|---|---|---|
| Example 15 | Bubble layer | 1118 | 3.0 | 8.9 | 3.0 | 0.1 | EXCELLENT |
| Example 16 | Bubble layer | 1002 | 2.3 | 6.1 | 2.6 | 0.0 | EXCELLENT |
| Comparative Example 4 | Reaction solution and bubble layer | 1220 | 3.7 | 12.7 | 3.4 | 3.0 | GOOD |

From the results shown in Table 4, it was confirmed that it is possible to produce a chain metal powder, which hardly contains a power having a long chain length and is nearly uniformed in the chain length having a short chain length, by separating a bubble layer formed on the surface of the reaction solution and collecting only a chain metal powder contained therein.

<<Production of Anisotropic Conductive Film>>

Example 17

In the same manner as in Example 14, except that the same amount of the chain metal powder produced in Example 15 was used, a 40 μm thick anisotropic conductive film was produced.

Example 18

In the same manner as in Example 14, except that the same amount of the chain metal powder produced in Example 16 was used, a 40 μm thick anisotropic conductive film was produced.

Comparative Example 5

In the same manner as in Example 14, except that the same amount of a conventional chain metal powder produced in Example 4 was used, a 40 μm thick anisotropic conductive film was produced.

With respect to the anisotropic conductive films produced in Examples 17 and 18 and Comparative Example 5, the connection resistance and the insulation resistance were measured and characteristics were evaluated. The results are shown in Table 5.

TABLE 5

| | Connection resistance (Ω) | Insulation resistance (GΩ) |
|---|---|---|
| Example 17 | 0.1 | 100 |
| Example 18 | 0.1 | 100 |
| Comparative Example 5 | 0.1 | 1 |

From the results shown in Table 5, it was confirmed that, according to the anisotropic conductive films of Example 17 and 18 in which the chain metal powder of the present invention was used, the insulation resistance in the plane direction of the film can be increased by preventing short circuiting due to falling down of the chain metal powder while maintaining the connection resistance in the thickness direction of the film at the same value, as compared with the anisotropic conductive film of Comparative Example 5 in which a conventional chain metal powder was used.

The invention claimed is:

1. A process for production of a chain metal powder formed by a reduction deposition reaction, which comprises the steps of reducing ferromagnetic metal ions contained in an aqueous solution through the action of a reducing agent while applying a magnetic field to the solution in a fixed direction thereby to deposit fine metal particles, and bonding a lot of the fine metal particles in a chain form so as to orient the fine metal particles in a direction of the applied magnetic field through magnetism of the fine metal particles, characterized in that the reduction deposition reaction is conducted in the presence of:

(a) a reducing agent for generating a gas during the reduction of metal ions, or a combination of the reducing agent and a foaming agent capable of generating a gas; and (b) a foamable water soluble compound for generating a bubble layer on the surface of the aqueous solution by generation of the gas, and the process comprises separating the bubble layer from the aqueous solution and then collecting the chain metal powder contained in the bubble layer.

2. The process for production of a chain metal powder according to claim 1, wherein a foamable dispersing agent is used as the foamable water soluble compound.

3. The process for production of a chain metal powder according to claim 1, wherein trivalent Ti ions clustered with tetravalent Ti ions are used as the reducing agent.

* * * * *

UNITED STATES PATENT AND TRADEMARK OFFICE

CERTIFICATE OF CORRECTION

PATENT NO. : 8,038,762 B2
APPLICATION NO. : 12/687014
DATED : October 18, 2011
INVENTOR(S) : Tetsuya Kuwabara et al.

It is certified that error appears in the above-identified patent and that said Letters Patent is hereby corrected as shown below:

On the title page of the patent, Item "(54)", change "PROCESS FOR PRODUCTION OF CHAIN METAL POWDERS, CHAIN METAL POWERS PRODUCED THEREBY, AND ANISOTROPIC CONDUCTIVE FILM FORMED BY USING THE POWDERS" to -- PROCESS FOR PRODUCTION OF CHAIN METAL POWDERS, CHAIN METAL POWDERS PRODUCED THEREBY AND ANISOTROPIC CONDUCTIVE FILM FORMED BY USING THE POWDERS --; and

In Column 1, Lines 1-4, change "PROCESS FOR PRODUCTION OF CHAIN METAL POWDERS, CHAIN METAL POWERS PRODUCED THEREBY, AND ANISOTROPIC CONDUCTIVE FILM FORMED BY USING THE POWDERS" to -- PROCESS FOR PRODUCTION OF CHAIN METAL POWDERS, CHAIN METAL POWDERS PRODUCED THEREBY, AND ANISOTROPIC CONDUCTIVE FILM FORMED BY USING THE POWDERS --.

Signed and Sealed this
Seventeenth Day of April, 2012

David J. Kappos

David J. Kappos
*Director of the United States Patent and Trademark Office*